United States Patent [19]

Deadman

[11] Patent Number: 4,491,103

[45] Date of Patent: Jan. 1, 1985

[54] AUTOMATIC ENGINE OIL LEVEL MAINTENANCE SYSTEM

[76] Inventor: Ray Deadman, 1236 W. 13th St., San Pedro, Calif. 90731

[21] Appl. No.: 500,142

[22] Filed: Jun. 1, 1983

[51] Int. Cl.[3] ..... F01M 1/18

[52] U.S. Cl. ..... 123/196 S; 123/196 R; 184/103 A; 184/103 R; 184/105 R

[58] Field of Search ..... 123/196 R, 196 S; 184/1.5, 103 R, 103 A, 105 R

[56] References Cited

U.S. PATENT DOCUMENTS

| | | | |
|---|---|---|---|
| 2,722,286 | 11/1955 | Lyttle | 184/103 A |
| 3,540,550 | 11/1970 | Bailey | 123/196 S |
| 3,876,037 | 4/1975 | Rath, Jr. | 184/103 R |
| 3,882,967 | 5/1975 | Gulla et al. | 184/103 R |
| 4,091,895 | 5/1978 | Lang | 184/103 R |
| 4,105,092 | 8/1978 | Zeildler et al. | 123/196 S |
| 4,299,307 | 11/1981 | Scott | 184/1.5 |

FOREIGN PATENT DOCUMENTS

| | | | |
|---|---|---|---|
| 485944 | 5/1938 | United Kingdom | 123/196 S |

*Primary Examiner*—E. Rollins Cross

*Attorney, Agent, or Firm*—Charles H. Thomas

[57] ABSTRACT

An internal combustion engine includes a lubricant level maintenance system. A reservoir is located externally of the engine. A pump is connected to the reservoir and a conduit leads from the pump to the engine oil pan. An electrical level sensing circuit includes a thermistor which is positioned in the engine oil pan, preferably by means of an engine dip stick. An enabling circuit is connected to receive an input from the sensing thermistor and from the engine electrical ignition system. The enabling means responsively provides an enabling signal to the pump following the elapse of a predetermined time interval when the engine is turned off. A tilt switch disables the sensing system to prevent distortion of the thermistor signal if the vehicle is parked on an incline.

11 Claims, 3 Drawing Figures

RESERVOIR
PUMP
DISPLAY
30
ELECTRONIC
CONTROLLER
COUNTER
DECODER

AUTOMATIC ENGINE OIL LEVEL MAINTENANCE SYSTEM

BACKGROUND OF THE INVENTION

1. Field of the Invention

The present invention relates to lubricant level maintenance systems applicable to internal combustion engines that employ electrical ignition systems, diesel engines, and other engines that require lubricant that is circulated through the engine block.

2. Description of the Prior Art

Various prior systems have been employed in association with the internal combustion engines of automotive vehicles to automatically check the oil level in engine oil pans. The oil level in such conventional systems is checked just as the engine is started. However, because the oil level check is performed immediately prior to commencement of a journey, there is a disinclination to add oil to the engine until after the journey has been concluded.

SUMMARY OF THE INVENTION

The present invention is an internal combustion engine lubricant level maintenance system. The lubricant level maintenance system of the invention includes a reservoir for holding a reserve supply of an engine lubricant, such as the motor oil used in virtually all internal combustion engines. A pump is coupled to the reservoir and a conduit system extends from the pump to supply oil to an engine oil pan. A lubricant level sensing means includes a sensor element, such as a thermistor, for positioning in the engine oil pan. The lubricant level sensing system provides a signal indicative of a deficiency of lubricant in the engine oil pan when such a deficiency exists. The deficiency signal is passed to an enabling circuit which is connected to the level sensing system and which is installed with connections to the engine or the engine ignition circuit. The enabling circuit enables the level sensing system following cessation of energization of the engine ignition circuit or cessation of operation of the engine. Upon receipt of a signal from the level sensing element indicating an oil deficiency in the oil pan, the enabling circuit enables the pump which then pumps lubricant from the reservoir to the engine oil pan.

A very important feature of the invention is that the enabling circuit and the lubricant level sensing mechanism are not actuated until the expiration of a predetermined delay interval once the engine has been turned off. The brief delay interval allows engine oil to drain down into the oil pan. This interval prevents an erroneous signal indicative of oil deficiency from being generated merely because the oil in the engine has not had sufficient time to drain down from the engine block and refill the pan.

Another very significant aspect of the invention is that the level deficiency check and the replenishment of oil occur after the electrical ignition system of the engine has been turned off and operation of the engine has ceased. This typically occurs after a journey has been completed or as the vehicle operator pulls into a service station for refueling. If the engine oil level is low and the reservoir is empty, an alarm signal will be generated once the vehicle engine is turned off. Procrastination in refilling the replenishment reservoir is therefore far less likely than with conventional systems. An individual is much more likely to take the time to replenish engine lubricant following conclusion of a trip or upon pulling into a service station for refueling. In contrast, a vehicle operator is less likely to replenish the reserve supply of lubricant in the reservoir if the operator is interrupted at the commencement of a trip upon turning on the ignition, or if the operator is only alerted to the need for additional lubricant following consummation of a refueling transaction when the vehicle is started to resume the journey.

A further very important feature of one preferred embodiment of the invention is that replenishment of engine oil from the reservoir supply is not improperly influenced by the physical attitude or inclination of the engine. When the vehicle operator parks the vehicle on the slope of a hill, an attitude sensing circuit ascertains whether or not the engine has assumed the normal, level disposition which it does when the vehicle is parked upon a level surface. If the vehicle is parked upon an incline, the attitude sensing circuit disables the lubricant level sensing system used to detect a deficiency of lubricant in the oil pan. Preferably, an attitude indicator is provided so that the vehicle operator is informed when the lubricant level sensing system has been disabled because of a departure of the vehicle from a level attitude.

Another very important feature of a preferred embodiment of the invention is that oil is pumped from the reservoir to the engine oil pan in a series of small incremental steps. Preferably, the reservoir pump will be actuated intermittently during a replenishment cycle. Time is thereby provided to allow replenishment oil to reach the oil pan from the replenishment reservoir before pumping additional oil from the reservoir. This step-wise conduct of the replenishment process thereby prevents an oversupply of replenishment oil.

Unlike some oil level checking systems, the lubricant level maintenance system of the present invention does not merely alert the vehicle operator that a deficiency of lubricant exists in the vehicle oil pan. Rather, the level maintenance system of the invention provides the necessary replenishment oil from the reservoir, yet avoids over-replenishment.

The various features and advantages of the lubricant level maintenance system of the invention may be described with greater clarity and particularity by reference to the accompanying drawings.

DESCRIPTION OF THE EMBODIMENTS

Figures 1, 2, 3:
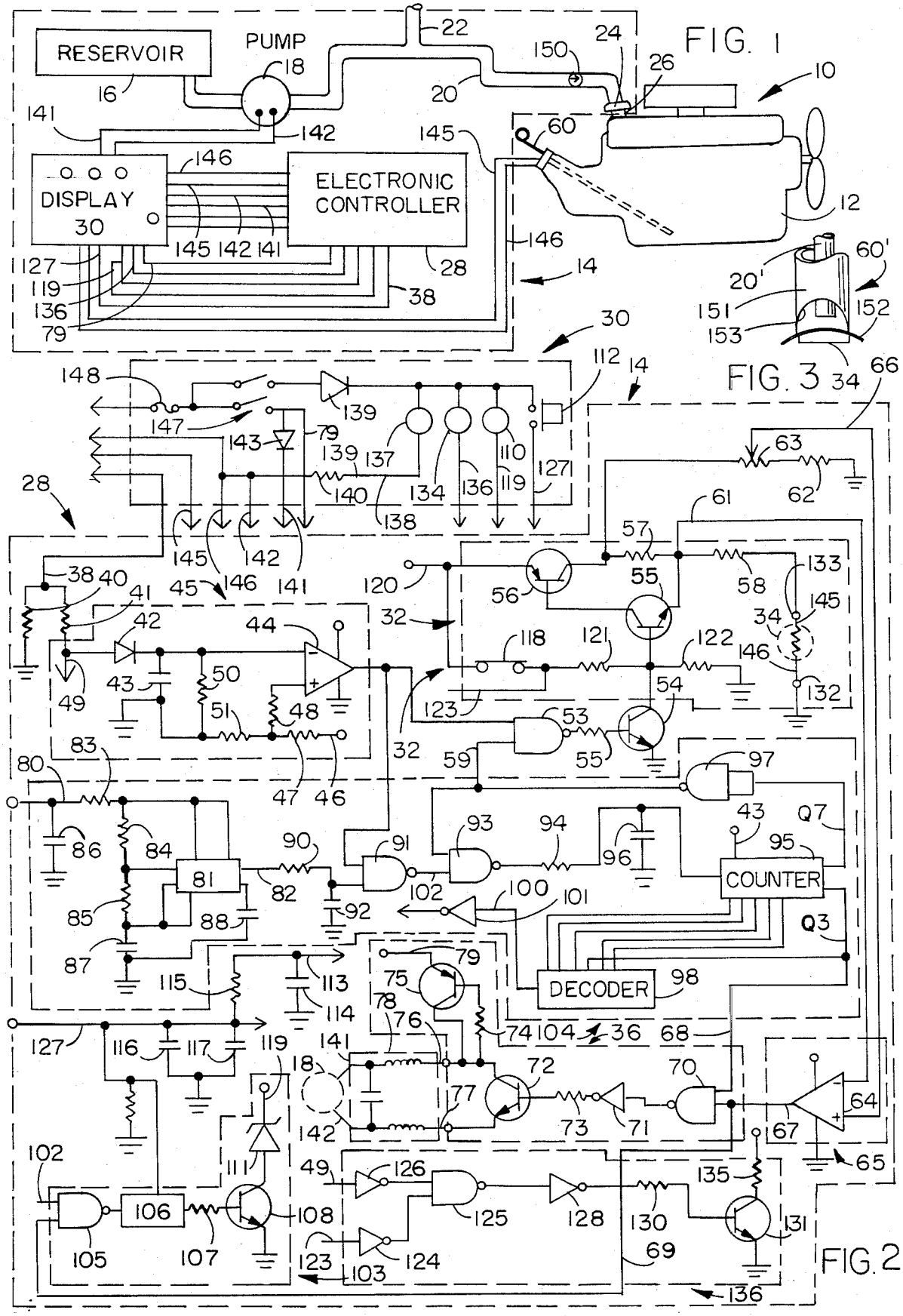
FIG. 1 illustrates an internal combustion engine in which the lubricant level maintenance system of the invention has been installed.
FIG. 2 is a schematic diagram of the lubricant level maintenance system of FIG. 1.
FIG. 3 is an elevational detail of a modified portion of the embodiment of the invention depicted in FIG. 1.

FIG. 1 illustrates an internal combustion engine 10 of the type used to power automobiles and trucks. The engine 10 has an oil pan 12 with lubricating oil therein. The engine 10 is powered by a conventional 12 volt direct current electrical ignition system operated by a key ignition switch in the cab of the vehicle. In the embodiment of the invention depicted, electrical current is supplied through the key ignition switch through an ignition coil and a distributor to sparkplugs for each of the cylinders of the engine.

FIGS. 1 and 2 illustrate a lubricant level maintenance system 14 according to the invention. The system 14 includes a reservoir 16 which is located externally relative to the engine 10. A fluid pump 18 is located in a conduit 20 which leads from the pump 18 to the engine oil pan 12. Preferably, the conduit 20 is provided with an air break 22 to prevent lubricant from being siphoned through the conduit 20. The conduit 20 delivers lubricant to the oil pan 12 of the engine 10 through an oil filler cap 24. The oil filler cap 24 is not a closed cap, but includes a short, annular neck to which the extremity of the conduit 20 is coupled by conventional fastening means.

According to the invention, a sensor probe may be combined with an otherwise conventional oil dip stick 60, which is inserted into the crankcase 12 through the usual dip stick sleeve characteristic of internal combustion engines. The thermistor 34 is located at the full level mark of the dip stick 60 and is normally immersed in the lubricant in the oil pan 12. The thermistor 34 serves as a lubricant deficiency sensing mechanism. The thermistor 34 is normally immersed in the oil standing in the engine oil pan 12 when the engine 10 is turned off. The oil thereby dissipates heat in the thermistor when the oil level in the pan 12 is adequate. When there is an oil deficiency, however, the thermistor 34 is no longer immersed and heat in the thermistor 34 is no longer dissipated.

A current through the thermistor 34 will therefore generate heat in the thermistor 34, which causes the thermistor resistance to drop.

The lubricant level maintenance system 14 of the invention includes an electronic controller 28, mounted at some convenient location in the vehicle, and a display unit 30, mounted in the vehicle cab. The electronic components of the embodiment of the level maintenance system 14 depicted in FIG. 1 are illustrated in detail in FIG. 2.

ELECTRONIC CONTROLLER 28

The electronic controller 28 is comprised of a delay circuit 45, thermistor enabling circuit 32, low oil level sensing circuit 65, pump enabling circuit 36, programmer circuit 104, alarm indicator circuit 103, tilt indicator circuit 136 and associated logic.

DELAY CIRCUIT 45

The function of delay circuit 45 is to delay the operation of the lubricant level sensing system 14 until the engine oil has had time to drain back into the oil pan 12.

The delay circuit 45 includes a diode 42, capacitor 43, resistors 50, 51, 48, 47 and an amplifier 44. When the vehicle engine ignition switch is on, line 38 is held high, and capacitor 43 is charged through diode 42. When the ignition switch is turned off, line 38 goes low and diode 42 is reverse biased. The charge on capacitor 43 must discharge through resistor 50 and the values of resistors 50, 51, 48 and 47 are selected such that the output of amplifier 44 will remain low until approximately 90 seconds after the ignition switch has been turned off. At that time, the output of the delay circuit 45 will go high and will remain high until the ignition switch is turned on.

The output of the delay circuit 45 is connected to one input of each of NAND-gates 91 and 53.

THERMISTOR ENABLING CIRCUIT 32

The other input to NAND-gate 53 is the program enable signal on line 59 from programmer circuit 104. This signal is high until the Q7 output of counter 95 goes high, at which time, the program enable signal goes low. The manner of operation of the programmer circuit 104 will subsequently be described in greater detail.

The output of NAND-gate 53 switches the transistor 54 off when in the low state, and saturates transistor 54 when in the high state. When transistor 54 is switched off, the junction of resistors 121 and 122 rises to approximately 7 volts. Transistors 55 and 56 constitute a high-gain emitter follower circuit and will cause the output of thermistor enabling circuit 32 to rise to approximately 6½ volts and to remain at that level until the program complete signal is generated by the programmer circuit 104.

LOW OIL LEVEL SENSING CIRCUIT 65

Thermistor 34 is positioned in the oil pan 12 of engine 10 at the normal oil level. If there is a deficiency of oil in the oil pan 12, thermistor 34 will no longer be immersed in oil. The output of the thermistor enabling circuit 32 will thereupon cause thermistor 34 to self-heat to a high temperature. When the temperature of thermistor 34 rises, its resistance will decrease, causing an increase of current through it, and a resultant increase in voltage drop across resistor 57. Sensing amplifier 64 is adjusted by means of a variable resistor 63 to provide a high output when thermistor 34 self-heats to a selected high temperature, as it will when not immersed in oil. The high output of sensing amplifier 64 is the low oil level signal on line 67. The low oil level signal is directed to the pump enabling circuit 36 and to the alarm indicator circuit 103 on line 69.

The output of sensing amplifier 64 will remain high until thermistor 34 is immersed in oil, or until the program complete signal from the programmer goes high, as will subsequently be described.

PUMP ENABLING CIRCUIT 36

The inputs to the pump enabling circuit 36 are the low oil level signal on line 67 from the low oil level sensing circuit 65 and the Q3 signal from the programmer 104 on line 68. Transistors 72 and 75 constitute a high gain switch, such that the output at 76 is high when the Q3 input to NAND-gate 70 on line 68 is high and the low oil level signal on line 67 is high. As a result, the pump 18 will be energized in accordance with the Q3 input from the programmer circuit 104 until the low oil level signal from sensing amplifier 64 drops. That is, the pump 18 will be alternately switched on and off until the oil level in the oil pan rises sufficiently to immerse and cool the thermistor 34.

The output of the pump enabling circuit 36 is connected to pump 18 through a hash filter 78. The hash filter 78 isolates the high electrical noise generated by the motor brushes in pump 18 from the logic circuits in the electronic controller 28.

PROGRAMMER CIRCUIT 104

The programmer circuit 104 generates the control signals for the electronic controller 28. The programmer circuit 104 includes a clock generator, a counter 95 and a decoder 98. The following signals are generated by the programmer circuit 104: (1) the program enable signal at the output of inverter 97; (2) the Q3 output of the counter 95; and (3) the reservoir status sample signal at the output of inverter 101.

The clock generator includes an integrated circuit 81 which is a timer, with resistors 84, 85, and capacitors 87 and 88. The values of these components are selected to produce the desired duration of the control signals from the programmer circuit 104.

Resistor 83 and capacitor 86 constitute a power supply decoupling circuit for the clock generator.

The output of the clock generator at line 82 is connected to NAND-gate 91 through a delay circuit formed by resistor 90 and capacitor 92. NAND-gate 91 functions as a gate to enable clock pulses from the clock generator to pass to the clock enable NAND-gate 93 only when the output of the delay circuit 45 is high, as previously described.

The other input to NAND-gate 93 is the program enable signal from the output of inverter 97. This signal is high until the Q7 output of the counter 95 goes high. The Q7 output of counter 95 will go high when the counter 95 receives its 64th clock pulse from NAND-gate 93.

The Q3 output of counter 95 goes high eight times while the program enable signal is high. The Q3 output is coupled to the pump enabling circuit 36, by line 68. The operation of the pump enabling circuit 36 has previously been described.

The Q3 output of counter 95 is also connected to the decoder 98. The function of the decoder 98 is to generate a reservoir status sample signal. The reservoir status sample signal occurs during the 63rd clock pulse from the clock enable NAND-gate 93. The reservoir status sample signal is sent to NAND-gate 105 of the alarm indicator circuit 103 on line 102. The counter 95 is reset to zero each time the engine ignition switch is turned on.

ALARM INDICATOR CIRCUIT 103

The alarm indicator circuit 103 enables the alarm indicator lamp 110 on the display unit 30. The purpose of the alarm indicator lamp 110 is to alert the driver of the vehicle that the lubricant level maintenance system needs attention. If the low oil level signal is still high during the reservoir status sample signal on line 102, NAND-gate 105 will set flip-flop 106 which will saturate transistor 108 and cause the alarm indicator 110 to flash. Zener diode 111 drops the voltage applied to the flashing alarm indicator lamp 110 to its rated operating voltage.

The most common cause of actuation of the alarm indicator lamp 110 is that the reservoir 16 is empty. Other events which can cause actuation of the alarm indicator lamp 110 include: malfunctions of the pump 18, restrictions in conduit 20, and malfunctions of the electronic controller 28. The alarm indicator lamp 110 can be disabled only by pressing the reset button 112 on display unit 30.

TILT INDICATOR CIRCUIT 136

The tilt indicator lamp 134 on display unit 30 will light when the ignition switch is turned off, if the vehicle is not level. The purpose of the tilt indicator lamp 134 is to alert the driver of the vehicle that the lubricant level maintenance system 14 is disabled. The system is disabled to prevent the lubricant level maintenance system 14 from pumping lubricant into the engine oil pan 12 when the lubricant level is not actually low, but may appear low only because the vehicle is not located on a level surface.

The tilt indicator lamp 134 in the display unit 30 is driven by transistor 131 through inverter 128 in the tilt indicator circuit 136. Inverter 128 will cause transistor 131 to saturate and light the tilt indicator lamp 134 if the output of NAND-gate 125 is low. This situation will exist if the engine ignition switch is turned off and at the same time, the tilt switch 118 in the thermistor enabling circuit 32 is opened. The vehicle operator is thereby alerted to the tilt condition immediately upon turning off the ignition switch, so that he may reposition the vehicle if he wants to enable the lubricant level maintenance system 14 of the invention.

DISPLAY PANEL 30

The display panel 30 is mounted in the vehicle cab in view of the vehicle operator. The display panel 30 includes the power switch 147, fuse 148, reverse polarity protection diodes 143 and 139, power indicator lamp 137, tilt indicator lamp 134, alarm indicator lamp 110 and reset button 112.

The power switch 147 controls the main power to the lubricant level maintenance system 14 through a protective fuse 148. The tilt indicator lamp 134 and the alarm indicator lamp 110 are respectively controlled by the tilt indicator circuit 136 and the alarm indicator circuit 103, as previously described.

MODIFICATIONS

It is quite possible to reroute the conduit 20 to enter the engine 10 through a modified form of the dip stick 60. In such an embodiment, a modified dip stick 60' depicted in FIG. 3, is constructed in a coaxial fashion with a central, annular replenishing conduit filler tube 20' at its center. An outer, surrounding sleeve 151 supports a transverse, arcuate shield 152 at the extremity of the dip stick 60'. The thermistor 34 is located on the underside of the shield 152, and lateral openings 153 are defined in the sleeve 151 just above the shield 152 to allow oil to laterally flow from the conduit inlet tube 20' into the oil pan 12 without impinging directly upon the thermistor 34. A direct flow of oil onto the thermistor 34 would tend to inordinately lower the thermistor temperature and thereby produce an erroneous signal indicating that an oil level deficiency in the crankcase no longer exists. Using the modified dip stick 60', there is no necessity for a specially designed oil filler cap, such as the filler cap 24 depicted in FIG. 1.

Other modifications of the invention are also possible. For example, the reservoir 16 may be a rigid walled reservoir, or it may be in the form of a flexible walled bag. The reservoir 16 is preferably positioned within the engine compartment of an automotive vehicle so that it is easy to reach and so that replenishing lubricant may be readily poured into the reservoir 16. The location of an easily accessible reservoir 16 is particularly advantageous when the invention is used with vans, motorhomes and recreational vehicles, where the conventional oil filler cap is often accessible only with considerable difficulty.

Another modification which is readily apparent is the design of the electronic controller 28 as a single microprocessor chip. There are a number of commercially available electronic chips which are capable of performing the tasks of the electronic controller 28.

It may be desireable to institute programming changes in the electronic controller 28. For example, the programmer timing may be changed for larger engines. That is, large engines may require more than eight cycles of operation of the pump 18. Also, more time should be allowed for oil to drain into the oil pans of larger engines prior to each operation of the pump 18.

The application of the lubricant level maintenance system 14 to diesel engines may also require some modifications from the embodiments illustrated. For example, the ignition of some diesel engines is turned off by a manually actuated valve which shuts off the supply of fuel to the engine. In such diesel engines, the lubricant level maintenance system of the invention, would be actuated by an electrical signal which is initiated by operation of the manually actuated valve.

Numerous other modifications and variations of the invention will also undoubtedly become readily apparent to those of ordinary skill in the art. Accordingly, the scope of the invention should not be construed as limited to the particular embodiments depicted and described, but rather is defined in the Claims appended hereto.

I claim:

1. A lubricant level maintenance system adapted to maintain an adequate level of lubricant in the oil pan of an internal combustion engine which employs an electrical ignition system comprising:

a reservoir located externally of said engine to store a reserve supply of lubricant, actuable lubricant feeding means coupled to said reservoir, conduit means leading from said lubricant feeding means for communication with the engine oil pan through an existing orifice in said engine, level sensing means, including a sensor element for positioning in an existing opening to the engine, to provide an actuating signal to said lubricant feeding means indicative of a deficiency of lubricant in said oil pan, enabling means having an input from said electrical ignition system and including an electrical timing circuit which is automatically triggered by de-energization of said electrical ignition system to provide an output to allow said level sensing means to actuate said lubricant feeding means only at the expiration of a pre-determined time interval, and tilt sensing means coupled to said level sensing means to allow said level sensing means to actuate said lubricant feeding means only when said vehicle is level.

2. A lubricant level maintenance system according to claim 1 in which said enabling means includes a programmer which provides an enabling signal of predetermined duration to said lubricant feeding means a plurality of times within a complete program cycle, such that the lubricant supplied by said lubricant feeding means has sufficient time to drain down into the oil pan and reach the sensing means, thereby preventing overfilling of the oil pan.

3. A lubricant level maintenance system according to claim 2 in which said programmer provides a reservoir status sample signal, and further comprising an alarm indicator circuit which lights an indicator on the display panel if said reservoir is empty.

4. A lubricant level maintenance system according to claim 1 in which said sensor element is a thermistor.

5. An internal combustion engine lubricant level maintenance system comprising:

a reservoir for holding a reserve supply of engine lubricant, a pump coupled to said reservoir, conduit means extending from said pump for coupling to an engine oil pan, lubricant level sensing means including means for positioning in an existing opening of said engine to provide a signal indicative of a deficiency of lubricant level in said oil pan, enabling circuit means connected to said level sensing means and adapted for connection to an engine ignition circuit and including a delay circuit which automatically responds to de-energization of said engine ignition circuit and which delays enablement of said level sensing means until elapse of a pre-determined time interval following cessation of energization of said engine ignition circuit, and an engine inclination checking device which disables said lubricant level sensing means when said engine is tilted.

6. A crankcase lubricant level maintenance system according to claim 5 including a reservoir status test circuit coupled to said enabling circuit means to ascertain whether said reservoir contains lubricant, and an alarm indicator coupled to said reservoir status test circuit.

7. A crankcase lubricant level maintenance system according to claim 5 further comprising remotely located display means and including a tilt indicator coupled to said inclination checking device to signal disablement of said lubricant level sensing means by said engine inclination checking device.

8. A crankcase lubricant level maintenance system according to claim 5 further comprising power indicating means to indicate receipt of electrical power.

9. A crankcase lubricant level maintenance system according to claim 8 further comprising a reservoir status testing device coupled to said reservoir and to said display means, and an alarm means is located in said display means to provide and indication as to whether said reservoir contains lubricant.

10. In an internal combustion engine having an oil pan with lubricating fluid therein and an electrically actuated ignition system, the improvement comprising a reservoir located externally relative to said engine, pumping means in communication with said reservoir, conduit means leading from said pumping means for communication with said engine oil pan through an existing aperture in said engine, lubricant deficiency sensing means located in an existing opening in said engine and extending into said oil pan and arranged to provide a signal indicative of a deficiency of lubricant in said oil pan, tilt sensing means to provide a signal indicative of the attitude relative to the horizontal of said engine, and pump enabling means coupled to said pumping means, said lubricant deficiency sensing means, said tilt sensing means and said ignition system to automatically interrogate said lubricant deficiency sensing means at a pre-determined time after de-energization of said ignition system and to enable said pumping means accordingly in the absence of a signal from said tilt sensing means indicating that said engine is tilted.

11. An internal combustion engine according to claim 10 in which said conduit means is provided with an air break and a check valve.

* * * * *